US007871499B2

(12) United States Patent
Gehring et al.

(10) Patent No.: US 7,871,499 B2
(45) Date of Patent: Jan. 18, 2011

(54) RETORT OVEN WITH ADJUSTABLE FLOOR

(75) Inventors: Michael W. Gehring, Bakersfield, CA (US); William Sweet, Bakersfield, CA (US)

(73) Assignee: Simeken, Inc., Cypress, CA (US)

( * ) Notice: Subject to any disclaimer, the term of this patent is extended or adjusted under 35 U.S.C. 154(b) by 531 days.

(21) Appl. No.: 11/927,137

(22) Filed: Oct. 29, 2007

(65) Prior Publication Data

US 2009/0107830 A1 Apr. 30, 2009

(51) Int. Cl.
*C10B 21/20* (2006.01)
*F23G 5/00* (2006.01)

(52) U.S. Cl. ..... 202/99; 202/105; 202/128; 202/262; 202/270; 110/242; 110/255; 110/246; 422/184.1

(58) Field of Classification Search ..... 202/96, 202/99, 128, 262, 270, 105; 110/235, 242, 110/255, 246; 432/239; 422/184.1
See application file for complete search history.

(56) References Cited

U.S. PATENT DOCUMENTS 3,467,035 A * 9/1969 Anderson et al. ..... 110/210
4,122,036 A * 10/1978 Lewis ..... 502/421
4,126,518 A * 11/1978 da Silva Bento ..... 201/27
4,339,999 A * 7/1982 Fio Rito et al. ..... 110/226
5,417,170 A * 5/1995 Eshleman ..... 110/235
5,997,288 A * 12/1999 Adams ..... 432/105
6,387,221 B1 * 5/2002 Schoenhard ..... 201/25
6,926,521 B2 * 8/2005 Meyer et al. ..... 432/78

FOREIGN PATENT DOCUMENTS

DE 2356039 * 6/1975

OTHER PUBLICATIONS

Machine English Translation DE 2356039.*

* cited by examiner

*Primary Examiner*—N. Bhat
(74) *Attorney, Agent, or Firm*—Fulwider Patton LLP

(57) ABSTRACT

A retort oven for decomposition of waste materials through pyrolysis employing a deck with a variable angle of inclination for adjusting the retention time and processing rate of waste material flowing unassisted through the oven interior. The oven includes an outer shell lined with a refractory material and houses an inner oven chamber. The deck is adjustably hinge mounted to the inner chamber supporting sidewalls extending in a decline from a waste material entrance to a charred material exit. The deck is operated in a preferred angle range of inclination between 28°-50° from the oven floor normal. A controlled heat source is positioned within the oven to heat a first outer volume whose heated gases are transferred into a second inner volume of the inner chamber using an array of heat gun tubes heating the deck and material as it descends along the declined deck. The deck can be adjusted for varying the retention time of material within the oven for varied exposure to heat and charring efficiency.

21 Claims, 6 Drawing Sheets

FIG. 7
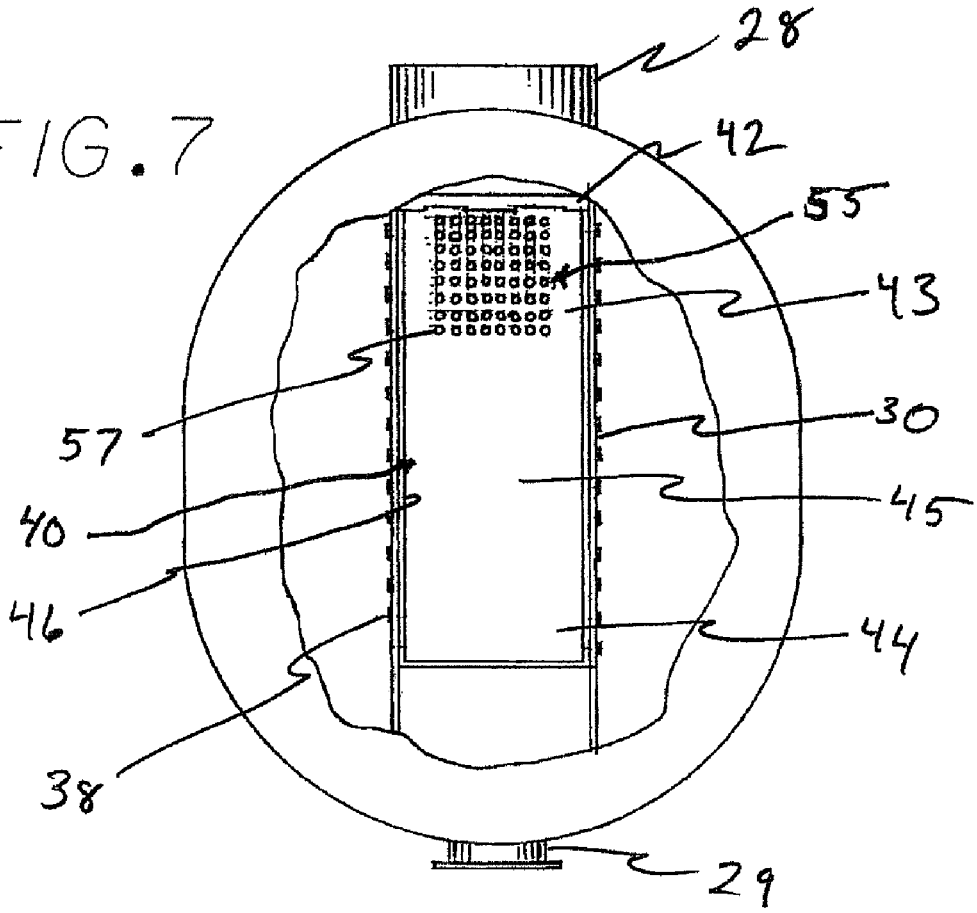
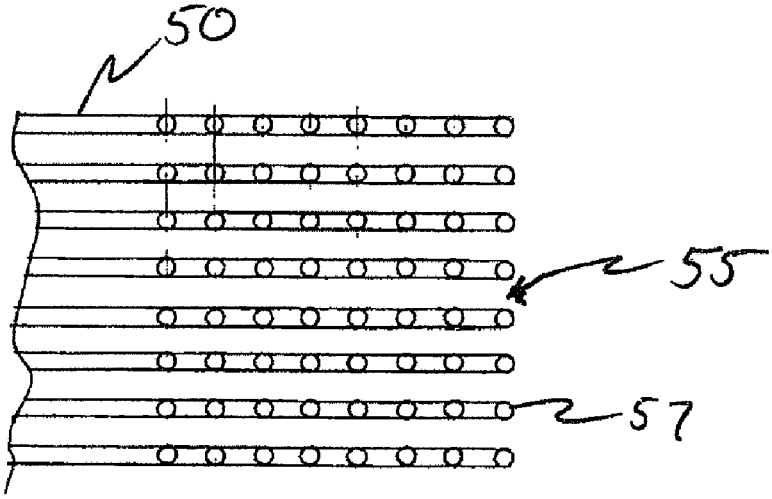
FIG. 8

RETORT OVEN WITH ADJUSTABLE FLOOR

FIELD OF THE INVENTION

The invention relates to ovens for processing waste materials.

BACKGROUND OF THE INVENTION

Increasing populations continue to produce a growing amount of waste material. Landfills are near capacity in some sites and there are those people that feel that landfills are a temporary solution with problems that surface in the future. Eliminating waste through some conventional means can produce other sources of contamination or waste that must be dealt with separately. In addition to managing waste disposal, some conventional waste processing techniques utilize heavy, fossil fuel run machinery whose fuel consumption collaterally produces further environmental contamination. Thus, while such equipment attends to one problem, their efficiency in eliminating or processing waste material can lead to undesirable results.

In The United States, some laws restrict the processes utilized to convert waste material. Simple torching and burning of indiscriminately mixed materials can produce thick plumes of noxious smoke and the mixed materials burned together can produce unintended combinations of poisonous gases or other chemical residues deleterious to the environment. Some efforts controlled processing by employing the use of ovens. In breaking material down, some of the material constituents reform as a gassed off vapor that may include volatile organic compounds (VOCs). VOCs that escape into the atmosphere readily react and contribute a negative impact on the environment. Thus, some efforts have led to implementing recycling techniques that are friendly to the environment by reducing the deleterious by-products from waste conversion and equipment operation.

One solution is to exploit the benefits of pyrolysis by processing material in an oxygen depleted environment. Ovens employing a pyrolytic environment will operate at temperatures typically above 800° F. where the heat and pressure cooperate to break down the chemical bonds of waste material. In an oxygen depleted environment, less gassing off occurs and less volatile organic compounds and smoke are produced than in conventional incineration techniques. A majority of the material is converted to char while other by-products may include oils. One of the benefits of pyrolytic processing derives from these byproducts being energy rich and reusable as a fuel source in other applications or for the oven itself. Thus, efficiency in extracting the energy rich constituents of waste materials is conducive to achieving optimal recycling of waste material.

The skilled artisan recognizes that inefficiency can lead to redundancy in processing material and thus, negatively impact the goal of producing an environmentally friendly converted product. Under-processed waste material can suffer twofold. In one sense, under-converted material translates into a loss of fuel product as the energy rich constituents of the waste material remain in their unusable state. In another aspect, under-converted material drives up operation costs as material must be re-introduced into the oven impacting both machinery fuel usage and material conversion production rates.

Some early retort ovens used a static approach to processing. Incinerators included a removable, heat resilient platform where material was placed onto the platform and inserted into the oven. After sufficient charring of material, the platform was removed and the ashes loaded into vessels for transport and additional waste material was loaded onto the platform and reinserted. Ovens using this kind of approach suffered from a slow processing rate of waste material.

Other solutions employed a conveyor system to move waste through an oven chamber converting the material into gas and Char and mechanically moving it out of the oven. Ovens of this type sometime suffer from periodic breakdown after multiple moving parts wear down in a superheated environment. Additionally, the construction of some ovens of this type exposed the oven chamber to external air allowing undesirable gases to escape uncontrolled into the environment.

Another proposed solution can be seen in U.S. Pat. No. 7,032,525 to Edmondson that teaches an oven using an angled ramp fixed in place between a material entrance and material exit where the oven interior is heated by a flue gas. The material to be processed is intended to glide or fall along the ramp from the material entrance to the material exit. An oven of this type suffers from an inability to adjust the movement rate and retention time of waste materials being processed so as to obtain an optimal charring result.

It can be seen therefore that a need exists in the art for a retort oven in which the waste material flow path may be adjusted in deck-angle fashion, thereby allowing for various types of waste materials to be retained within the oven for different times while providing an efficient, material transfer system.

SUMMARY OF THE INVENTION

The retort oven of the present invention comprises an outer shell housing an inner oven chamber within its interior. Mounted within the inner oven chamber is a deck pivotally mounted to the chamber interior walls positioned to transfer waste between a material feed entrance and a material exit. The oven chamber also includes a controlled heat source positioned to heat the chamber interior to the desired temperature.

The deck defines a portion of the inner oven chamber floor pivotally mounted by a hinge to the oven chamber side walls to adjustably form a tilting or declining portion of the floor between the material feed and exit. The oven chamber side walls also include a series of slots parallel to one another aligned with the sides of the deck. The deck sides include bolts fastening the deck to the oven chamber sidewalls through the slots thereby providing for the sliding adjustment of the angle of the deck up and down the sidewalls pivoted about the hinge. Preferably, the deck is positioned at an angle of between 28°-50° from the floor as the deck is in the oven.

The inner oven chamber is spaced from the outer shell to form a cavity therebetween said cavity being heated during operation of the oven. Heat insulating refractory material lines the interior wall of the outer shell. The heat system includes an external heat source and an array of heat gun tubes connected to the heat source transferring the heat energy into the inner chamber interior. The oven may further include an oxygen sensor, a pressure sensor, and a temperature sensor for monitoring the processing environment within the chamber. An air valve may be included to introduce external gases into the inner chamber. Additionally, vacuum means and a gas discharge port are coupled to the oven to draw gases out of the chamber interior.

Other features and advantages of the invention will become apparent from the following detailed description, taken in conjunction with the accompanying drawings which illustrate, by way of example, the features of the invention

BRIEF DESCRIPTION OF THE DRAWINGS

FIG. 7 is a partial end view of the retort oven shown in FIG. 1;

FIG. 8 is an enlarged sectional view taken along the line 8-8 in FIG. 5;

DETAILED DESCRIPTION OF THE PREFERRED EMBODIMENTS

Figure 1:
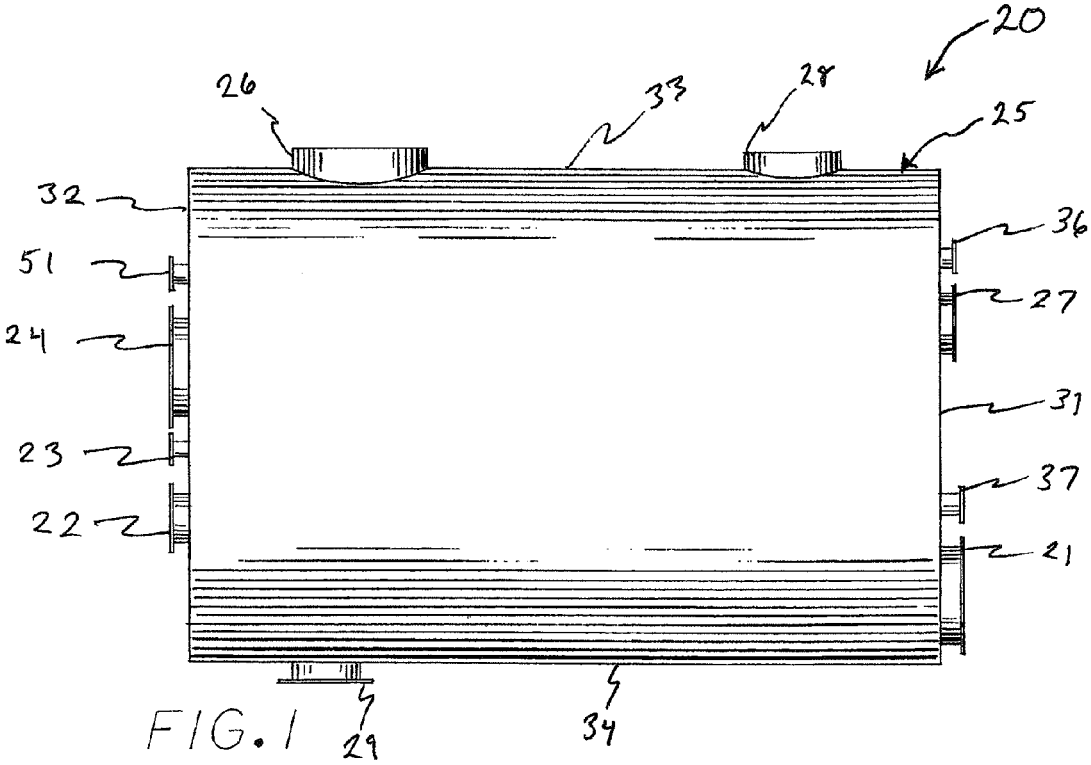
FIG. 1 is an elevation view of the retort oven of the present invention.
Figure 5:
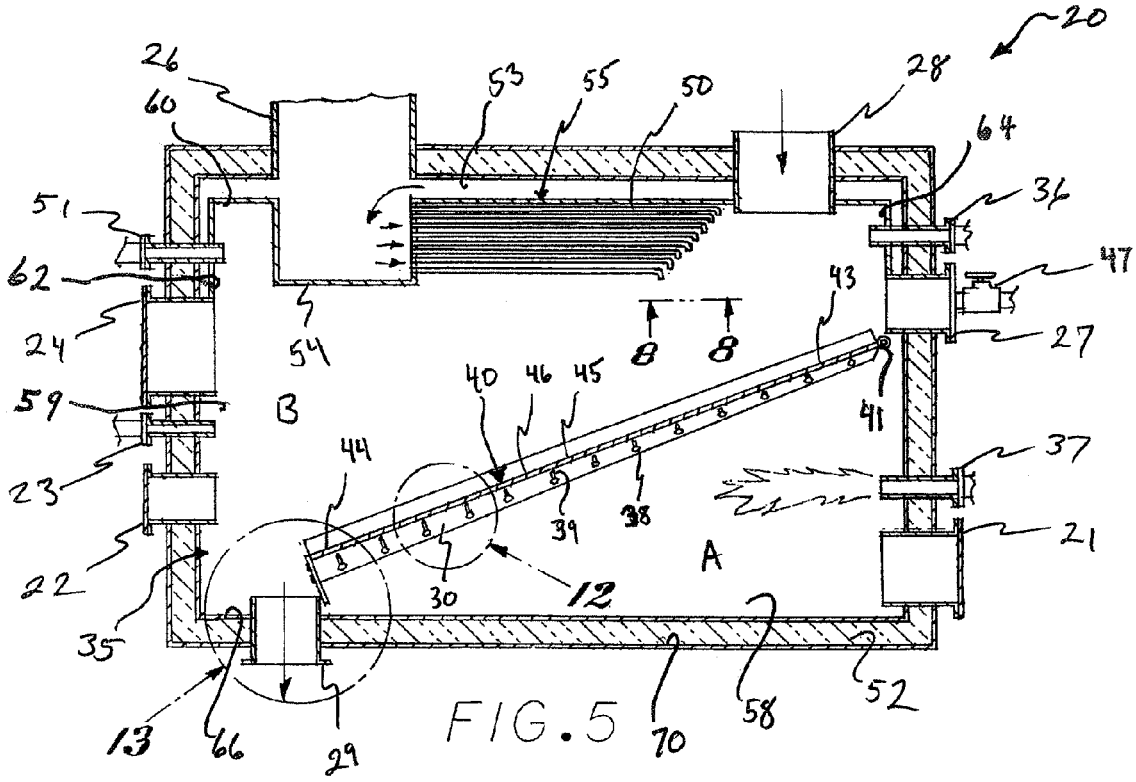
FIG. 5 is an elevation view, in cross-section taken along the line 5-5 shown in FIG. 4.

Referring to FIGS. 1 and 5, a preferred embodiment of the retort oven 20 of the present invention generally includes an inner oven chamber 35 spaced within an outer shell 25. An adjustable floor portion or deck 40 of the inner oven chamber is pivotally mounted within the oven chamber and positioned to provide a transfer path for waste material during processing from a waste material feed entrance 28 to a processed waste material vent 29. A heat source 37 is coupled to the outer shell for heating the oven interior.

Figure 2:
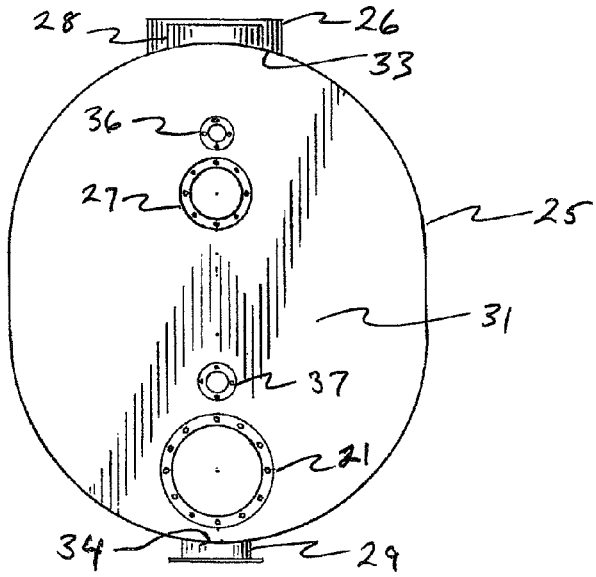
FIG. 2 is a flat end view of the retort oven shown in FIG. 1.
Figure 3:
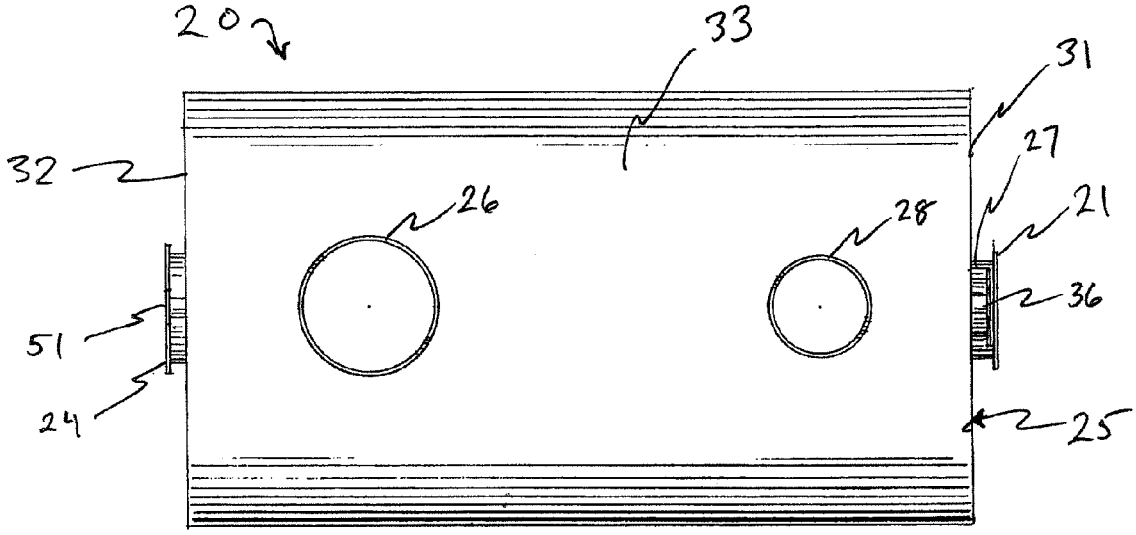
FIG. 3 is top view of the of the retort oven shown in FIG. 1.
Figure 4:
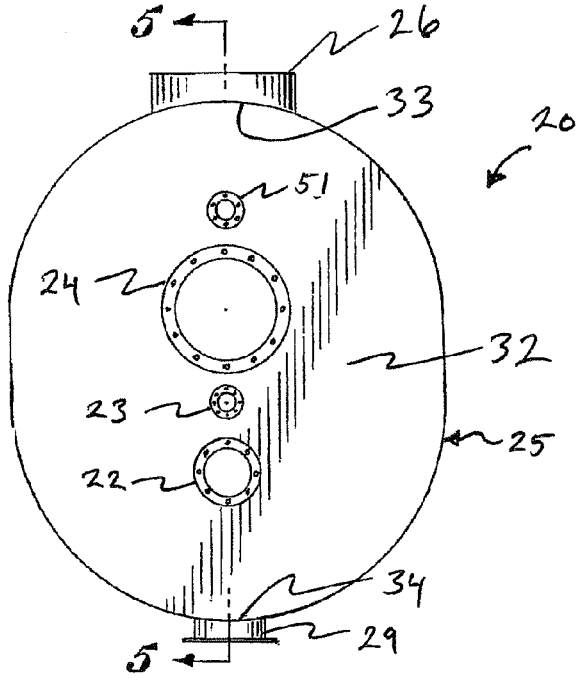
FIG. 4 is a second end view of the retort oven shown in FIG. 1.

Referring to FIGS. 1-4, the oven 20 includes an outer shell 25 made from a heat resistant and durable material such as carbon steel and formed generally oblong with rounded top and bottom surfaces 33 and 34 and opposing end surfaces 31 and 32 incorporating multiple ports and sensors coupled to the shell and projecting into the oven interior. For the sake of orientation, the end face 31 will be considered the first end of the oven and the end face 32 will be designated the second end. The shell top surface 33 is formed with the material feed 28 near the first end face 31 and with a personnel access way 26 formed near the second end face 32. The shell bottom surface 34 is formed with the processed waste material vent 29. Referring to FIGS. 1-2, and 5, the first end face 31 includes from top to bottom and projecting through into the oven interior, an oxygen sensor 36, a view port 27 aligned with the upper end 43 of the deck 40, an auxiliary air valve 47, a fired heat source 37 and lower first end access port 21. Referring to FIGS. 3-5, the second end face 32 includes from top to bottom and also projecting into the oven interior, a pressure sensor 51, a gas discharge vent 24, a temperature sensor 23, and a lower second end access port 22 horizontally aligned for visual inspection of the deck lower end 44. Those skilled in the art will recognize that the orientation and placement of ports or sensors can be adjusted or modified depending on the size or shape of the oven or its placement in a larger system. Additionally, those skilled in the art will recognize that the oven can be configured in a square or rectangle or other geometric configuration.

Figure 6:
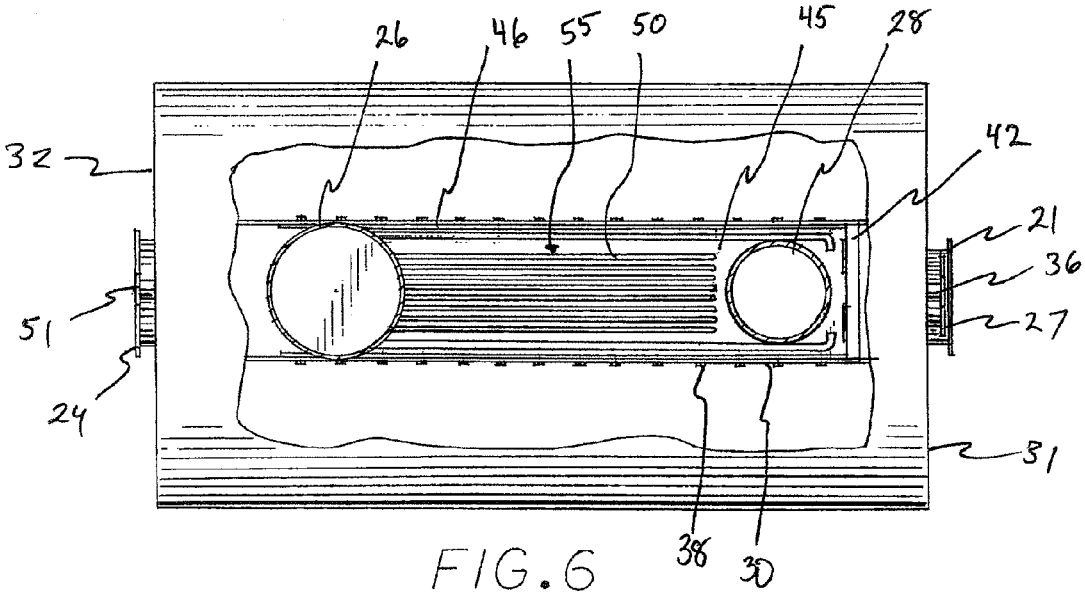
FIG. 6 is a partial top plan view of the retort oven shown in FIG. 1.

Referring to FIGS. 5 and 6, the inner oven chamber 35 is spaced from the outer shell 25 to define two volumes, outer volume 58 and inner volume 59. Inner volume 59 comprises the interior space within the inner oven chamber bordered by inner chamber top wall 60, side wall 62, side wall 64, floor portion 40, bottom wall 66, and side walls 30. The walls of the inner chamber are constructed of a high temperature conductive and resilient material such as 310 or 314 or 314H stainless steel or Nickel Alloy as needed by the feed material. The top wall 60 and side wall 62 are formed planar to the shell second end face 32 and top surface 33. The bottom portion of the inner chamber and inner volume 59 is defined by the floor portion 40 intersecting the side wall 64 end and descending diagonally at an adjustable grade toward the processed material vent 29. Outer volume 58 encompasses the surrounding space between the outer shell 25 and inner chamber 35 including the open area formed underneath the floor portion 40 facing the deck bottom surface (not shown). Additionally, a gas passageway 53 is formed in the upper portion of the oven between the shell and inner chamber providing access of heated gases from outer volume 58 into inner volume 59.

Referring to FIGS. 5-8, the heating system of the oven 20 includes a heat source 37 providing fired heating of gases within outer volume 58 that are conveyed into inner volume 59. Heat refractory insulation material 52, such as ceramic effective to 2200° F.-2400° F., lines the inner walls 70 of the outer shell diffusing and conserving heat energy within the oven. A gas plenum 54 is connected to passageway 53 and positioned in vertical alignment with the access port 26. An array 55 of heat gun tubes 50 made from heat conductive material projects from the plenum in staggered rows with heat gun muzzles 57 pointing toward floor surface 45. In one embodiment, the array is formed in an 8×8 matrix with an additional pair of heat gun tubes extending beyond the vertical path of the material feed opening as shown in FIG. 6.

Figure 9:
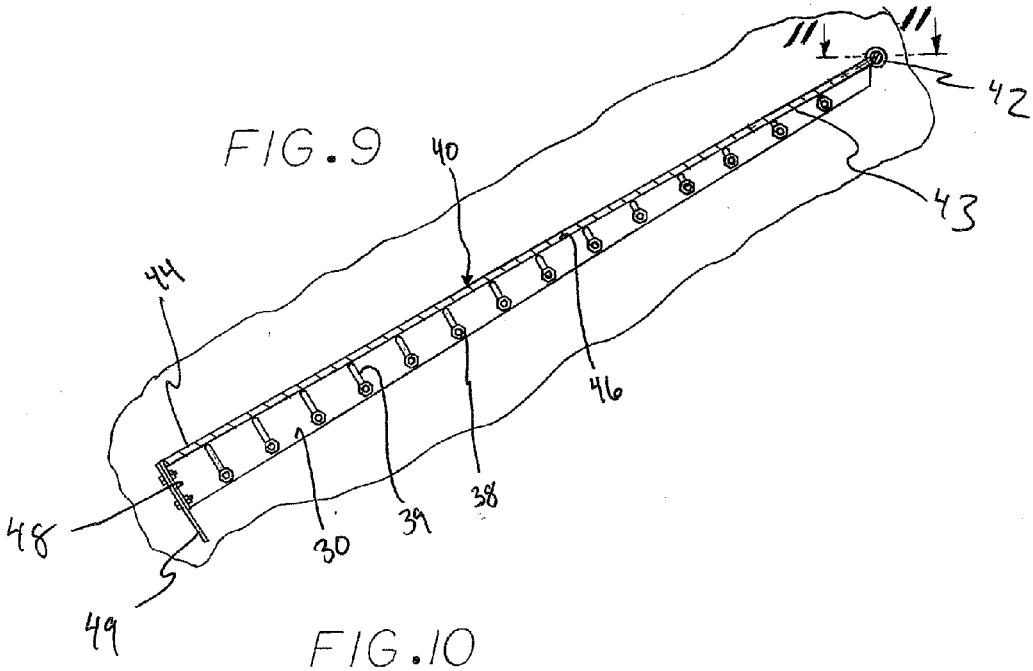
FIG. 9 is a sectional view, in enlarged scale of the deck shown in FIG. 5.
Figure 10:
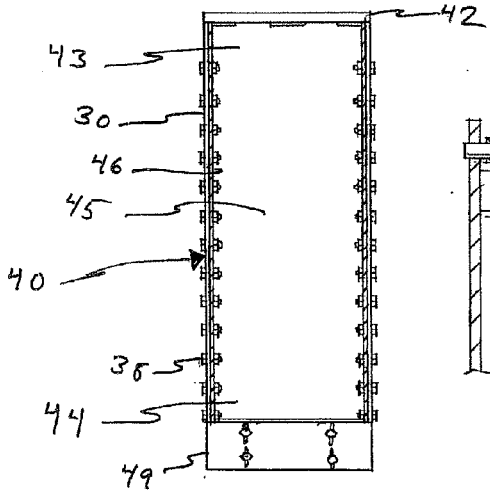
FIG. 10 is a top view of the deck shown in FIG. 5.
Figure 11:
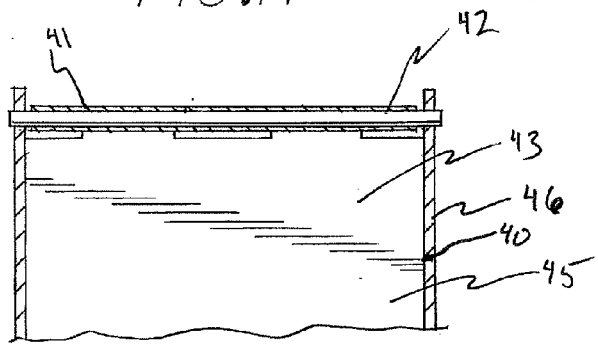
FIG. 11 is a partial top view taken along the line 11-11 in FIG. 10.
Figure 12:
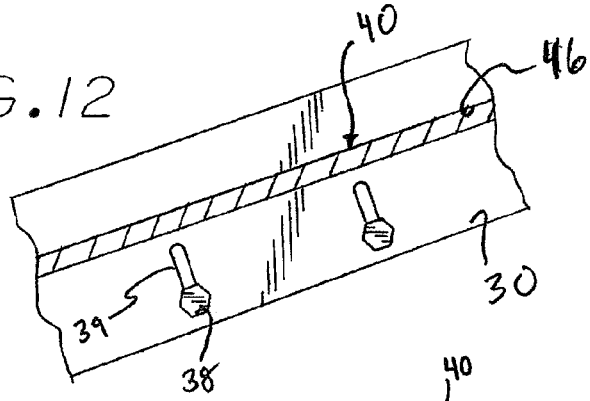
FIG. 12 is an enlarged partial side view of the deck shown in FIG. 5.
Figure 13:
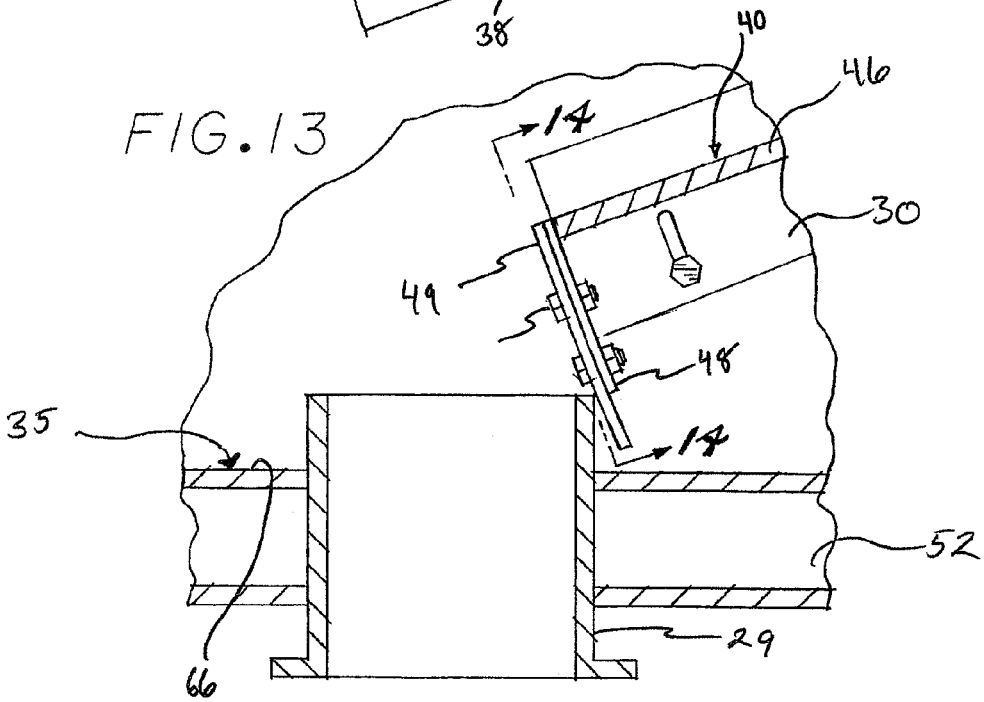
FIG. 13 is an enlarged partial side view of the deck shown in FIG. 5.
Figure 14:
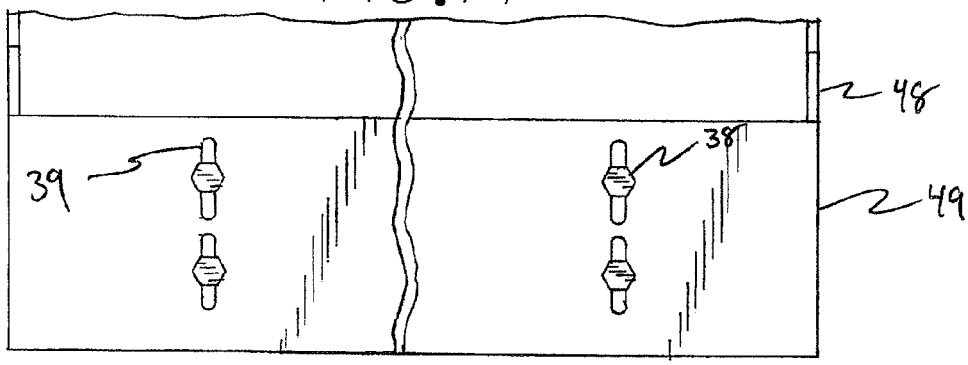
FIG. 14 is an end view of the deck taken along line 14-14 in FIG. 13.

Referring to FIGS. 9-14, the floor portion 40 is supported by inner chamber side walls 30 for adjustable tilting of the floor at varying angles. A hinge 42 and hinge support 41 couple the floor upper end 43 to the side walls 30 and side wall 64 creating a pivot point allowing for the altering of angle of incline. Controlling the incline angle can be achieved by slidably coupling the floor side walls 46 to the inner chamber side walls 30. For example, (as shown in FIGS. 9 and 12), a series of parallel slots 39 may be incorporated into the side walls 30 cooperating with matching floor bolts 38 attached to the floor side walls 46 providing lateral support and controlled pivoting of the floor portion 40 along its length. Additionally, referring to FIGS. 9-10 and 13-14, the floor end face 48 incorporates a face plate 49 using a similar slide coupling as employed along the side walls, thus providing a sealed division of volumes while allowing the floor end face to slide up and down above and in front of the processed material vent 29.

In operation, the operator will set the floor portion to a particular grade depending on the desired retention time of a particular waste material selected for processing. We have discovered that for many applications, such as vulcanized rubber or bio-medical waste products, material can be processed to about 98% efficiency by adjusting the floor portion to angle between 28°-32° from the floor normal. Those skilled will recognize that this angle can vary depending on the height and length construction of the oven. For example, increasing the dimensions of the oven may then require the optimal floor angle to range between 35°-50° where a longer material travel path may necessitate a steeper angle of transfer. The operator will then fire the heat source 37 building the heat energy gradually until a desired temperature is reached. The temperature will be calculated to a predetermined level between 800° F.-1800° F. to char a particular waste material to a desired degree of efficiency during an expected duration of travel along the floor portion. When processing material such as vulcanized rubber or medical waste, the operating temperature will typically range between 1200° F.-1500° F. The presence of oxygen will be drawn out of the oven and oxygen levels will be monitored when a pyrolytic environment is desired. Heated gases will build in the volume surrounding the inner chamber creating a pressure differential between that volume and the volume of the inner chamber. The heated gases will then flow through the gas passageway into the gas plenum where gases will flow into distribution among the heat gun tubes. The heated gases will charge the tube walls with heat energy and flow out the muzzles distributing the heat energy into the inner chamber air volume heating the length of the inclined floor portion.

It will be appreciated that the oven includes a heating system conducive to efficiently transfer thermal energy to waste material. A selected waste material will be fed into the oven at a controlled rate employing such known feed means as conveyor systems and air locks. Convectively, as the waste material falls down the material feed into the inner chamber, the heated air will immediately begin processing the material on its descent. Material will land on the heated floor upper end where heat conduction will transfer more thermal energy from the floor to material. An operator can monitor the landing of material from the view port 27 checking for material clogs or obstructions on the upper end of the floor. The material will descend down along the grade further absorbing heat energy radiated from the array of heated heat gun tubes above it. An operator may then, from the vantage point of either the port 21 or port 22, monitor the flow of material as it approached the lower end of the floor or its descent through the vent 29. It will be appreciated that depending upon the waste material being processed, the speed at which the material travels along the angled floor 40 may also vary. The operator, after examining the processed material for efficient charring, can cool the oven down and then adjust the floor grade to a shallower angle for under-processed material. Conversely, if material is efficiently processed part-way through the oven, the floor grade can be adjusted to steepen to increase the output and processing rate of material. As material is processed, gassed off vapors are drawn up and out of the chamber through the gas discharge vent 24 by a pressure differential created by means such as a vacuum pump or fan venting.

It will be further appreciated that the adjustable floor portion 40 provides a sealed environment for controlling air composition and material flow. Material descending along the floor will be funneled within the chamber by the side walls 30. The internal air composition will, in some applications, be primarily oxygen depleted. However, it will be understood that oxygen or another auxiliary gas can be introduced into the inner oven chamber in controlled fashion by the use of the air valve 47 assisting in accelerating or decelerating the burn rate of material as monitored by the oxygen, pressure, and temperature sensors. Additionally, the sealed walls of the inner chamber will assist in inhibiting uncontrolled air from entering the inner volume. It will also be recognized that mounting the floor to move along the side walls and in conjunction with a protective and sliding face guard inhibits material from spilling out of the inner chamber volume into the outer volume of the shell.

From the foregoing, it will be appreciated that the retort oven of the present invention is a relatively economical and maintenance efficient apparatus for processing waste material. The overall arrangement provides a versatile and responsive system for charring and moving material through the system and adjusting the charring time of materials passing through.

We claim:

1. An oven for processing waste materials, comprising:

an outer shell including a shell interior and an exterior shell surface;

an inner oven chamber housed within the shell interior including a chamber interior, a material entrance positioned in the upper portion of the oven chamber and formed to project through the exterior shell surface and a material exit positioned in the lower portion of the oven chamber penetrating through the exterior shell surface;

a pivot;

a deck pivotally mounted on the pivot within the oven chamber interior, said deck being angled to provide a pathway for transferring the waste material from the material entrance to the material exit; and a controllable heat source for heating the oven chamber interior; wherein the angle of said deck may be selectively adjusted about the pivot from a first set grade to a second set grade to increase or decrease the retention of the waste material within the oven chamber.

2. The oven for processing waste materials of claim 1, wherein:

the deck includes a first end pivotally mounted to the upper portion of the chamber interior.

3. The oven for processing waste materials of claim 1, wherein:

the deck is adjustable to an angle of 28°-50°.

4. The oven for processing waste materials of claim 1, wherein:

the oven chamber includes at least one oven sidewall incorporating a plurality of elongated apertures; and the deck includes at least one deck sidewall incorporating a plurality of mounting bolts mounting the deck to the oven sidewall, the mounting bolts aligned with and slidably fitted within their respective slots.

5. The oven for processing waste materials of claim 1, wherein:

the oven chamber includes a gas discharge port penetrating through the exterior shell surface and vacuum means drawing gas out of the chamber interior.

6. The oven for processing waste materials of claim 1, wherein:

the heat source includes a plurality of heat gun tubes communicating a heat energy from an external source into the oven chamber interior.

7. The oven for processing waste materials of claim 1, wherein:

the outer shell includes a shell interior surface and the oven chamber is spaced from the shell interior surface to define a cavity therebetween; and the oven further includes a heat insulative refractory material lining said cavity.

8. The oven for processing waste materials of claim 1, further comprising:

an oxygen sensor coupled to the oven chamber to measure the oxygen content within the oven chamber.

9. The oven for processing waste materials of claim 1, further comprising:

an air control valve coupled to the chamber interior for controlled introduction of gas therein.

10. The oven for processing waste materials of claim 1, further comprising:

a pressure sensor coupled to the oven chamber to measure the pressure inside the oven chamber.

11. An oven for processing waste materials, comprising:

an outer shell including a shell interior and exterior;

an inner oven chamber positioned within the shell interior including a chamber interior, a material entrance positioned in the upper portion of the oven chamber formed to project through the shell exterior and accept a feed of the waste material into the chamber interior and a material exit positioned in the lower portion of the chamber formed to project through the shell exterior;

an oven chamber floor portion pivotally connected to the oven chamber interior to form an adjustable inclined surface that is selectively adjustable from a first set grade to a second set grade, the floor including an upper end positioned under the material entrance and a lower end positioned to communicate processed waste material to the material exit; and a controllable heat source positioned to heat the chamber interior.

12. The oven for processing waste materials of claim 11, wherein:

the oven chamber includes vertical sidewalls; and the floor portion is inclined within a range of 28°-50° to the normal.

13. The oven for processing waste materials of claim 11, wherein:

the heat source includes an array of heat gun tubes positioned to radiate heat onto material communicated along the floor portion.

14. The oven for processing waste materials of claim 11, wherein:

the oven chamber interior includes a gas discharge port penetrating through the outer shell and vacuum means for drawing a gas out of the inner oven chamber.

15. The oven for processing waste materials of claim 11, wherein:

the inner oven chamber is spaced from the outer shell defining a cavity therebetween; and further includes an insulated refractory material positioned in the cavity.

16. The oven for processing waste materials of claim 11, further comprising:

an oxygen sensor coupled to the oven chamber to measure the oxygen content within the oven chamber.

17. The oven for processing waste materials of claim 11, further comprising:

an air control valve coupled to the chamber interior for controlled introduction of gas therein.

18. An oven for processing waste materials, comprising:

an outer shell including a shell interior;

an inner oven chamber housed within the shell interior including a chamber interior formed with a pair of sidewalls, a material entrance positioned in the upper portion of the oven chamber and formed to project through the shell and a material exit positioned in the lower portion of the oven chamber penetrating through the shell formed to pass processed material out of the outer shell;

a deck mounted to the sidewalls of said interior chamber including first and second ends positioned within the oven chamber interior, the first end positioned adjacent the material entrance for receiving waste material and the second end terminating adjacent the material exit forming a grade between the first and second ends and disposed to transfer processed material into the material exit;

adjustment means for selectively adjusting the angle of the deck from a first set grade to a second set grade; and a fired heating source positioned within the shell interior for heating the oven chamber.

19. The oven for processing waste materials of claim 18, wherein:

the tilt means include a hinge on the first end and deck locking bolts mounting the deck to the sidewalls to cooperate in adjusting the grade.

20. The oven for processing waste materials of claim 18, wherein:

the deck is mounted adjustable between a grade of 28°-50° from an oven chamber floor normal.

21. The oven for processing waste materials of claim 18, wherein the adjustment means includes a series of parallel slots incorporated into at least one of the sidewalls.

* * * * *